US009336700B2

(12) United States Patent
Lashina et al.

(10) Patent No.: US 9,336,700 B2
(45) Date of Patent: May 10, 2016

(54) LIGHT FEEDBACK ON PHYSICAL OBJECT SELECTION

(75) Inventors: Tatiana Lashina, Eindhoven (NL); Gerrit Hollemans, Eindhoven (NL); Evert Jan Van Loenen, Waarle (NL); Sander Bernard Francis Van De Wijdeven, Eindhoven (NL); Kero Van Gelder, Eindhoven (NL); Markus Gerardus Leonardus Maria Van Doorn, 'S-Hertogenbosch (NL); Vincentius Paulus Buil, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1172 days.

(21) Appl. No.: 12/301,324

(22) PCT Filed: May 9, 2007

(86) PCT No.: PCT/IB2007/051746

§ 371 (c)(1), (2), (4) Date: Nov. 18, 2008

(87) PCT Pub. No.: WO2007/141675

PCT Pub. Date: Dec. 13, 2007

(65) Prior Publication Data

US 2009/0189775 A1 Jul. 30, 2009

(30) Foreign Application Priority Data

Jun. 7, 2006 (EP) ..... 06115086

(51) Int. Cl.
*G08B 5/22* (2006.01)
*G09F 27/00* (2006.01)

(52) U.S. Cl.
CPC ..... *G09F 27/00* (2013.01)

(58) Field of Classification Search
None
See application file for complete search history.

(56) References Cited

U.S. PATENT DOCUMENTS

| | | | | |
|---|---|---|---|---|
| 4,142,216 | A * | 2/1979 | Goss et al. | 360/72.1 |
| 4,595,990 | A * | 6/1986 | Garwin et al. | 708/141 |
| 4,930,236 | A | 6/1990 | Hart | |
| 5,337,225 | A | 8/1994 | Brookman | |
| 5,821,872 | A * | 10/1998 | Brown et al. | 340/5.91 |
| 6,118,888 | A * | 9/2000 | Chino et al. | 382/118 |
| 6,481,877 | B1 | 11/2002 | Bello, Jr. | |
| 6,774,792 | B1 | 8/2004 | Williams | |
| 6,846,094 | B2 | 1/2005 | Luk | |
| 2002/0013144 | A1 * | 1/2002 | Waters et al. | 455/414 |
| 2002/0180588 | A1 | 12/2002 | Erickson et al. | |
| 2003/0040922 | A1 * | 2/2003 | Bodin | 705/1 |

(Continued)

FOREIGN PATENT DOCUMENTS

| | | | |
|---|---|---|---|
| CN | 1765672 | A | 5/2006 |
| DE | 10252697 | A1 | 5/2004 |

(Continued)

*Primary Examiner* — Curtis King
(74) *Attorney, Agent, or Firm* — Meenakshy Chakravorty

(57) ABSTRACT

A highlighting method and an interaction system (100) include at least one controllable light emitting source (110) linked to an item (120); and a processor (140) configured to turn on the controllable light emitting source (110) in response to user selection of the item (120). The controllable light emitting source (110) may be embedded in a mat (210) or a strip (430). The mat (210) may include a matrix of photo detectors or pressure sensors configured to detect the base or footprint of the item (120) when placed on the mat (210). The periphery of the product or the footprint may be illuminated upon selecting the product. Alternatively or additionally, a background surface behind the product may be illuminated upon selection thereof.

19 Claims, 4 Drawing Sheets

(56) References Cited

U.S. PATENT DOCUMENTS

| | | | | |
|---|---|---|---|---|
| 2003/0057887 | A1 | 3/2003 | Dowling et al. | |
| 2006/0022214 | A1 | 2/2006 | Morgan et al. | |
| 2006/0092072 | A1 | 5/2006 | Steiner | |
| 2007/0069867 | A1 * | 3/2007 | Fleisch et al. | 340/309.16 |
| 2007/0080805 | A1 * | 4/2007 | Franklin et al. | 340/572.1 |
| 2007/0182555 | A1 * | 8/2007 | Walker et al. | 340/572.1 |
| 2009/0051532 | A1 * | 2/2009 | Van Der Poel | 340/572.1 |
| 2009/0189775 | A1 | 7/2009 | Lashina et al. | |

FOREIGN PATENT DOCUMENTS

| | | | |
|---|---|---|---|
| EP | 1422923 | A2 | 5/2004 |
| JP | H08160897 | A | 6/1996 |
| JP | H1091867 | A | 4/1998 |
| JP | H11205202 | A | 7/1999 |
| JP | 2001046212 | A | 2/2001 |
| JP | 2003058092 | A | 2/2003 |
| JP | 2003271084 | A | 9/2003 |
| JP | 2004259241 | A | 9/2004 |
| JP | 2004326208 | A | 11/2004 |
| JP | 2005056117 | A | 3/2005 |
| JP | 2005156591 | A | 6/2005 |
| JP | 2005211552 | A | 8/2005 |
| WO | 2005124450 | A1 | 12/2005 |
| WO | 2006048831 | A1 | 5/2006 |
| WO | 2007015200 | A2 | 2/2007 |
| WO | 2007138504 | A2 | 12/2007 |

* cited by examiner

LIGHT FEEDBACK ON PHYSICAL OBJECT SELECTION

This application is a national stage application under 35 U.S.C. §371 of International Application No. PCT/IB2007/051743 filed on May 9, 2007, and published in the English language on Dec. 6, 2007 as International Publication No. WO/2007/141675, which claims priority to European Application No. 06115086.8, filed on Jun. 7, 2006, incorporated herein by reference.

The present invention relates to an interaction solution for providing system feedback as result of a user selecting an object, such as in an interactive shop window, for example, based on using controllable light sources that are linked to the object.

For entertaining customers and for the sake of providing extra information about products, retailers already deploy various display technologies ranging from large LCD or plasma displays to transparent projection screens. These displays can often be found installed in shop windows where they are used to display video clips, a slide show with announcements or information about the shop or their products. Most of the currently used shop window displays are pure informative non-interactive screens. More advanced shop window displays offer some interactivity with the display on a basic level, where a user can press a button on or near the display to activate some functionality, such as go to a next or previous page.

A more attractive shop window can be realized by combining physical products exhibited behind the shop window and a shop window display that would show information about the product the user is interested in. Such a shop window display system may infer the interest of the user either using gaze tracking or pointing gestures detection, as described in European Patent Application Serial Number 05107205.6, filed Aug. 4, 2005, entitled "Augmented Shop and Show Windows" which corresponds to International Publication Number IB2006/052603 which is incorporated herein by reference in its entirety. In such an interactive shop window, the user may look or point at a physical product. The looking/gazing and/or pointing is detected by the shop window, in response to which the shop window displays information about the product on the display. Such a shop window is advantageous since it enables the user to both be able to actually see the real physical product and at the same time get additional (digital) information, including various interactive services provided/suggested on the display.

Typically, the fast renewal rate for products, including display thereof in shop windows, for example, as well as the complexity of technologies used in consumer electronics, makes it rather difficult to be and remain up to date for both sales personnel and clients regarding new products and their features or specifications. As a result, customers complain that they get poor support from sales personnel. Thus, customers or consumers are obliged to conduct a self study first, using the Internet, information folders and specialized magazines or reviews for example, before they even enter a shop to start asking relevant questions.

In typical Graphical User Interface (GUI) design practice, feedback regarding system status is often provided. This principle follows one of the usability heuristics that stresses the importance of the visibility of system status. Such a principle follows the notions that the system should always keep users informed about what is going on or status, through appropriate feedback within reasonable time. Following this principle in GUI design, it is a common practice to highlight an item of focus or the one that has been activated by the user. For tangible user interfaces, it has been demonstrated to highlight a physical object using a projection, e.g. in what is referred to as reactTable or SmartSkin.

In shop windows for example, it is important to provide customers with feedback indicating which product is selected by 'highlighting' the product, similar to the feedback techniques used in GUIs. However, a highlighting using a projection or a spot light will be hardly visible, particularly during daylight, since most shop windows are placed outside and exposed to natural light.

Another problem with using a spot light for product highlighting is that the system will be limited with respect to the number of products that can be highlighted, and how close to each other products would be positioned, as many spot lights are needed that are configured to shine on the various products. Another limitation is that the layout of the products, or shelves containing the products, needs to be adjusted for proper combination of product placement and spot lights locations/direction of the shining lights therefrom, so that no product is placed in the way of the spot light to prevent light blockage from the spot light to the desired/illuminated product.

Accordingly there is a need for a better interactive system for providing feedback as result of the user selecting an object in the interactive shop window, for example, based on using controllable light sources that are linked to the object.

One object of the present systems and methods is to overcome the disadvantages of conventional interactive systems.

This and other objects are achieved by a highlighting method and an interaction system that include using light emitting surfaces for placing products so that each segment of the surface can be assigned to a product and switched on and off independently, for example, thus illuminating and/or highlighting products independently using desired light(s) having desired attributes. Instead of a light-emitting surface(s), light-emitting mats placed under every object may also be used. By using red, green and blue (RGB) light emitting diode (LED) arrays embedded into a mat or a surface for example, a color coding scheme may be used while highlighting a product. Each place where a product is placeable may include an embedded RFID reader (having a known position) so that the system, such as a shop window system, may automatically detect products that include RFID chips and update the positions of the products as detected by the RFID reader(s), such as the nearest RFID reader. Thus, a link may be established with a product so that the system knows where the product is positioned and can update the link if a product is relocated to another position.

As most shops or other establishments typically already work with database management tools containing the inventory of all their products, it is a relatively small step for product suppliers or others to make information about products available electronically so that such information would be added, e.g., to the inventory database and thus may be displayed on the shop window display, for example.

In one embodiment, the system comprises at least one controllable light emitting source linked to an item, and a processor configured to turn on the controllable light source in response to user selection of the item. The controllable light source may be embedded in a mat or a strip. The mat may include a matrix of photo detectors or pressure sensors configured to detect the base or footprint of the item when placed on the mat. The periphery of the product or the footprint may be illuminated upon selecting the product. Alternatively or additionally, a background surface behind the product may be illuminated upon selection thereof. The controllable light source may include at least one of a light emitting diode, incandescent, fluorescent, halogen, and high intensity discharge light source. The systems and methods for providing feedback are responsive to user selection of a physical object, e.g., displayed in a shop window. The user selection may be effectuated with a gesture, gaze or by any other selection means.

Further areas of applicability of the present systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

These and other features, aspects, and advantages of the apparatus, systems and methods of the present invention will become better understood from the following description, appended claims, and accompanying drawing where:

The following description of certain exemplary embodiment(s) is merely exemplary in nature and is in no way intended to limit the invention, its application, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed system and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 1:
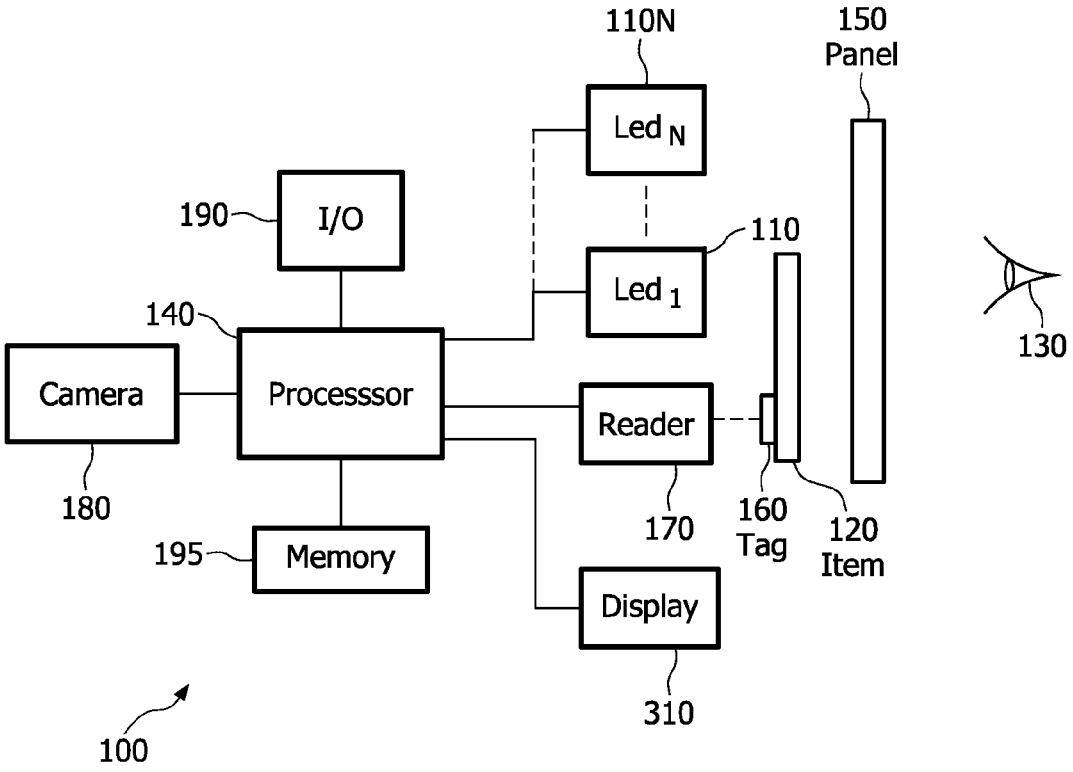
FIG. 1 shows an interactive system according to one embodiment of the present invention.

FIG. 1 shows an interactive system 100 having a controllable light source 110 linked to an item 120 viewed by a viewer or user 130. A processor 140 configured to turn on the controllable light source 110 in response to user selection of the item 120. Of course, the processor 140 may be configured to control multiple light sources 110 to 110N. The object/item 120 may be any item, such as a product displayed in a shop window, in which case there typically is a transparent glass, plastic or other transparent material or panel 150 between the object 120 and the viewer 130. It should be understood that the object 120 and the location may be any object and location displayed for viewing or using by the viewer/user 130. For example, the object 120 may be artwork displayed in a museum for interactive physical exhibits, with or without any material 150 between the object 120 and the viewer 130.

A sensor or tag 160 having a unique identification number, such as a radio frequency identification (RFID) tag, may be attached to, or embedded in the item or product 120. The tag 160 may be configured to link the controllable light source, which may be LEDs embedded in a surface to form a light emitting surface 110 to the item 120. A reader 170 is configured to read the RFID tag 160, for example, when the item 120 is substantially near, such as nearest tag 160. The RFID reader 170 may be associated with a at least one LED, such a group or matrix of LEDs embedded in a mat or surface. For example, each mat or a portion of a larger light emitting surface includes an RFID reader 170 configured to read the RFID tag 160 of the nearest product, for example, and link the product 120 to the particular mat or portion of the light emitting surface.

Of course, multiple products or items may be associated with the interactive system 100, such as multiple artworks in a museum or multiple products displayed in a retail shop window. Each item would be tagged with its own RFID tag, and each tile or mat 210, shown in FIG. 2, having at least one controllable light emitting source 110, such as an LED or a group or matrix of LEDs, may have its own tag reader 170 for reading RFID tag(s) 160 positioned on or near the particular tile or mat, thus linking the products 120 to the tiles/mats 210 and providing location information of the products in relation to the various tiles/mats in the retail shop window, for example.

The RFID tags 160 may be attached to each product 120 by the shop owner, or may be embedded in the product 120 by the manufacturer, for example. It has been forecasted that within a couple of years, such as by 2008, all products may to be tagged with an RFID chip. By installing short-range RFID readers 170 into the shelves and/or mates 210 behind the shop window 150 where products 120 are placed, the interactive system 100 may detect products 120 and maintain their actual location. This will allow to automatically update the links between a product 120 and an LED mat/tile 210 or shelf on which the product 120 is placed as soon as the product has been placed on one of the shelves. As would be apparent to one skilled in the art in view of the present disclosure, any other tags/readers maybe used instead of RFID tags/readers, such as for example bar codes and associated bar code readers, or any other tag and associated tag reader.

LEDs are light sources that are particularly well suited to controllably provide light of varying attributes, as LEDs may easily be configured to provide light with changing colors, intensity, hue, saturation, beam width, spot size and other attributes, and typically have electronic drive circuitry for control and adjustment of the various light attributes. Further, LED based systems are becoming more readily available, as described in U.S. Patent Application Publication Number 2006/0022214, published on Feb. 2, 2006, to Morgan et al., entitled "LED Package Methods and Systems" which is incorporated herein by reference in its entirety. However, any controllable light source may be used that is capable of providing lights of various attributes, such as various intensity levels, different colors, hue, saturation, beam width, spot size and the like, such as incandescent, fluorescent, halogen, or high intensity discharge (HID) light and the like, which may have a ballast or drivers for control of the various light attributes.

In one embodiment, each product is placed on, near or next to a light emitting tile 210, or a group of tiles, similar to mats or tiles available from Senssacell Inc. as described below. As soon as a user selects a product 120 exhibited behind the shop window glass 150, such as by looking or pointing at it, the product 120 gets selected and highlighting is activated, such as by switching on the LEDs 110 of the corresponding tiles 210 linked to the product 120.

For example, LEDs around the bottom contour of the object 120 may be activated creating an "aura" effect, where the object contour is automatically detected with the detectors 220 embedded into the top surface of the tile 210. Such contour detectors 220 may be a matrix of photo detectors that are covered and thus darkened by the product contour when the product 120 is placed on the mat/tile 210, or any other suitable detectors, such as a matrix of pressure sensors for example that detect the weight, and thus contour, of the product 120 placed on the tile/mat 210. Alternatively or in addition, it may be desirable to position exhibits or products 120 on flexible arrays of LEDs integrated into flexible elastic or fabric mats, where every LED can be separately controlled, thus allowing the LEDs around the product bottom contour to be turned on to provide the "aura" effect similar to products 350, 360, 370 shown in FIG. 3 which are surrounded with rings of colored light.

Figure 2:
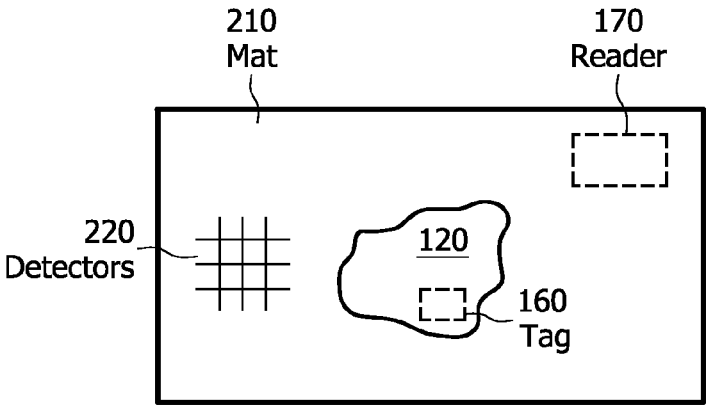
FIG. 2 shows a mat or tile according to another embodiment of the present invention.

Tiles or mats 210 shown in FIG. 2, having controllable light sources, may be implemented using for example the senssacell system available from Senssacell Inc., of Brooklyn, N.Y., USA, and may be attached to each other to form large interactive sensor surfaces. The senssacell system includes non-contact sensors that can detect, through capacitive sensing or sensing of changes in electric fields, for example, objects and people up to 6" away through non-conductive material such as glass, plastic, rubber, wood, etc. The sensors automatically track and adapt to environmental changes such as product placement on or near the senssacell tiles or surfaces. Each tile has bi-directional communication ability, e.g., through a network(s) or an interface(s), to communicate with adjoining tiles or to receive and provide data through the network, which may include feedback information for system interactivity with user actions, for example.

Illustratively, the feedback information may be related to product placement and/or product selection including highlighting the product and providing additional information related to the product itself, or similar products in accordance with software instruction running on the processor 140 shown in FIG. 1, for example. Such tiles or surfaces include LED arrays controllable by the system processor 140 or a separate dedicated controller operationally coupled to the system processor 140. The LEDs may be configured to be controllable for providing light with desired/selectable/programmable light attributes, such as brightness, intensity, color, hue, saturation, beam size, direction, etc, useful for providing feedback information to the system user, for example.

The tiles may interface and be connected to other tiles to provide any desired shape or surface. For example, an entire wall may be tiled with such sensors, where each tile or groups of tiles may be individually controlled and may have different information displayed, printed or attached thereon. Illustratively, touching or nearly touching one of the tiles provides distinct information including audio/visual or multimedia presentation about a particular product or service, which may be displayed on a nearby display screen, for example, or printed on the tile/mat. Other mats that include LEDs are also described in U.S. Pat. No. 6,481,877, issued Nov. 19, 2002, to Roberto Bello Jr., entitled "Lighted Automotive Floor Mats," which is incorporated herein by reference in its entirety, where mats with individually or collectively controllable LEDs, in conjunction with contour detectors 220 for example, may be used to illuminate a product 120 upon selection thereof by the user or viewer 130.

As described, many objects 120 may be displayed in close proximity or otherwise. An item selection means allows selection of one or more of the objects 120, such as via detectors that detect viewer's gaze and/or pointing at the physical item 120, or pointing to a virtual item or icon displayed on a screen of a device, e.g., a screen 310 (also shown in FIG. 3) projected onto the shop window 150, or a screen of a portable device such as a personal digital assistant (PDA) or mobile phone that communicates with the system 100 through a short range wireless link, such as Bluetooth. The window showcase for example is mapped onto the screen of the device, where the user 130 can point on the screen and select one or more of the objects 120. In response to user selection of an item(s) 120, the interactive system 100 is configured to provide feedback related to the selected item 120. The feedback may be in the form of highlighting the selected item, such as providing light from the LEDs 110 embedded in the tiles/mats 220 for example.

The user may select an item 120 among many items by pointing to the object itself where a camera 180 connected to the processor 140 which are configured to detect the user selection, such as using gaze tracking or pointing gestures detection, as described in European Patent Application Serial Number 05107205.6, filed Aug. 4, 2005, entitled "Augmented Shop and Show Windows". Alternatively, the user may select an item 120 by pointing on a screen 310 displaying the plurality of selectable items, such as using a mouse or any other input/output device or simply his/her finger 190, such as a keyboard, or a pointer/finger in the case of a touch-sensitive display. As is well known, a memory 195 is provided which is operationally coupled to the processor 140 for storing data including operating system and application data to be accessed and executed by the processor to achieve desired functions and results.

In response to selection by the user 130 of an item 120, the processor 140 controls the LEDs 110 to emit light of desired attributes to illuminate the selected item 120, as its location is determined as described using tags 160 attached to the item 120, and tag readers 170 linked to the LEDs 110, for example.

If RGB LEDs are used in the light emitting tiles or mats 210, it is then possible to deploy color-coding as described in European Patent Application Serial Number 06114760.9, filed May 31, 2006, entitled "Mirror Feedback on Physical Object Selection" which corresponds to International Publication Number PCT/IB2007/051743 which is incorporated herein by reference in its entirety.

Figure 3:
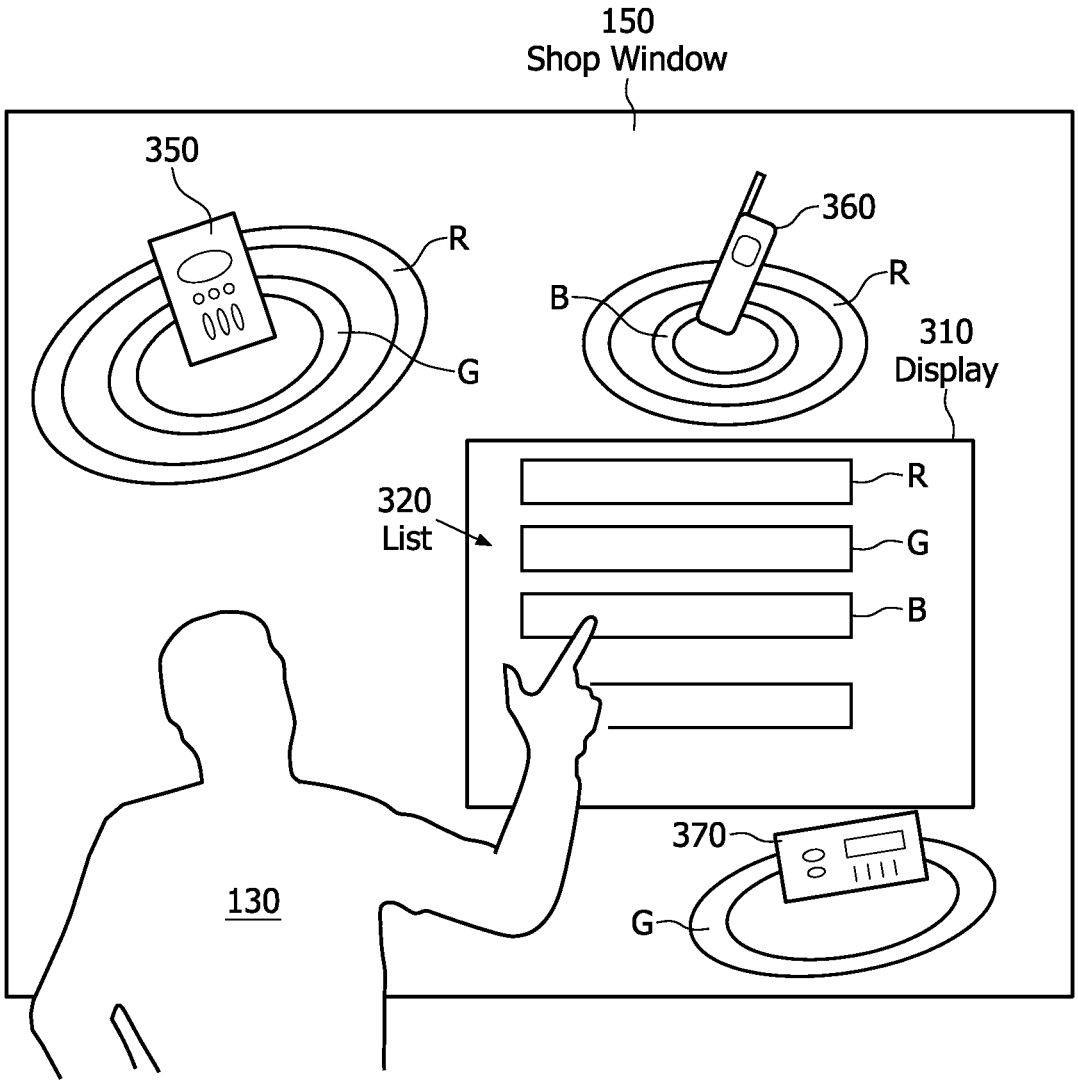
FIG. 3 shows an interactive shop window display according to further embodiment of the present invention.

When using LED arrays having LEDs configured to provide light with several selectable attributes, several colors may be used simultaneously for example to highlight several product selection or search criteria. This may be done as follows: first a user selects one or more search criteria on the shop window display 310 as shown in FIG. 3, which is projected onto the shop window 150 for example. Each criteria included in a selected list 320 displayed on a shop window display 310 is color coded, as indicated in FIG. 3 by R for red, G for green and B for blue. Of course any other desired colors may be used for color coding, including varying intensities of the various colors. Next, products 350, 360, 370 behind the shop window 150 also get highlighted using the colors corresponding to the features included in the respective products. For example, the product 350 has features that are color coded as R and G such as displayed on the shop window display 310, and is thus highlighted by R and G colors. Similarly, the product 360 has features that are color coded as R and B, and is thus highlighted by R and B colors, while the product 370 only has the feature which is color coded G, and is thus highlighted only using light having G or green color.

By looking at the various highlighted items, highlighted with same or similar color and/or intensities, the user 130 immediately sees which products comply with all selected criteria or with some of the selected criteria. For example, products that match most of selected criteria may be highlighted with substantially the same light attributes of the selected features included in list 320, while other products having less and less matching criteria are highlighted with less colored rings as shown in FIG. 3.

It should be understood that any other highlighting means may be used configured to distinguish between products or product features. For example, related products may all be illuminated to show both relations and differences to the selected features or the selected product(s), where illustratively the same color is used to highlight related products or features, where the most relevant product or feature is highlighted using light of a relatively high intensity, while less relevant yet related products or features are highlighted using light of a relatively low intensity. Illustratively, light having the same color as the color of the light highlighting the selected product or feature is used to highlight related features/products, where product with less or descending matching criteria or features have less or descending light intensities of substantially the same or similar color.

Of course, the system may be programmed to highlight certain related products in response to feature or product selection by the user 130, such as programmed by the shop owner for products that are discounted, for example. Other color scheme may be used or selected by the user, such as using colors from green for products with closely or most matching criteria to red least matching criteria.

In addition to highlighting related products with suitable colors in accordance with matching the selected criteria, the search result may also be simultaneously duplicated on the shop window display 310 as a list 320 of features or products, where items or products can be activated with touch to get more information about an item. The list 320 displayed on the shop window display 310 may also contain items available in stock but not exhibited behind the shop window 150.

Further, for example, color-coding may be used to distinguish between feedback provided to different users interacting with the shop window simultaneously, where user A is assigned the color red, user B is assigned the color green, user C is assigned the color blue, user D is assigned the color orange or any combination of color, hue, saturation and/or light intensity. In such a color-coded scheme, each user receives feedback using the color assigned to that user by the system 100, or an available color selected by the user, e.g., from the user's PDA or mobile phone, the shop window display 310, or other devices that are operationally coupled to the system 100, through any links, wired or wireless for example.

Figure 4:
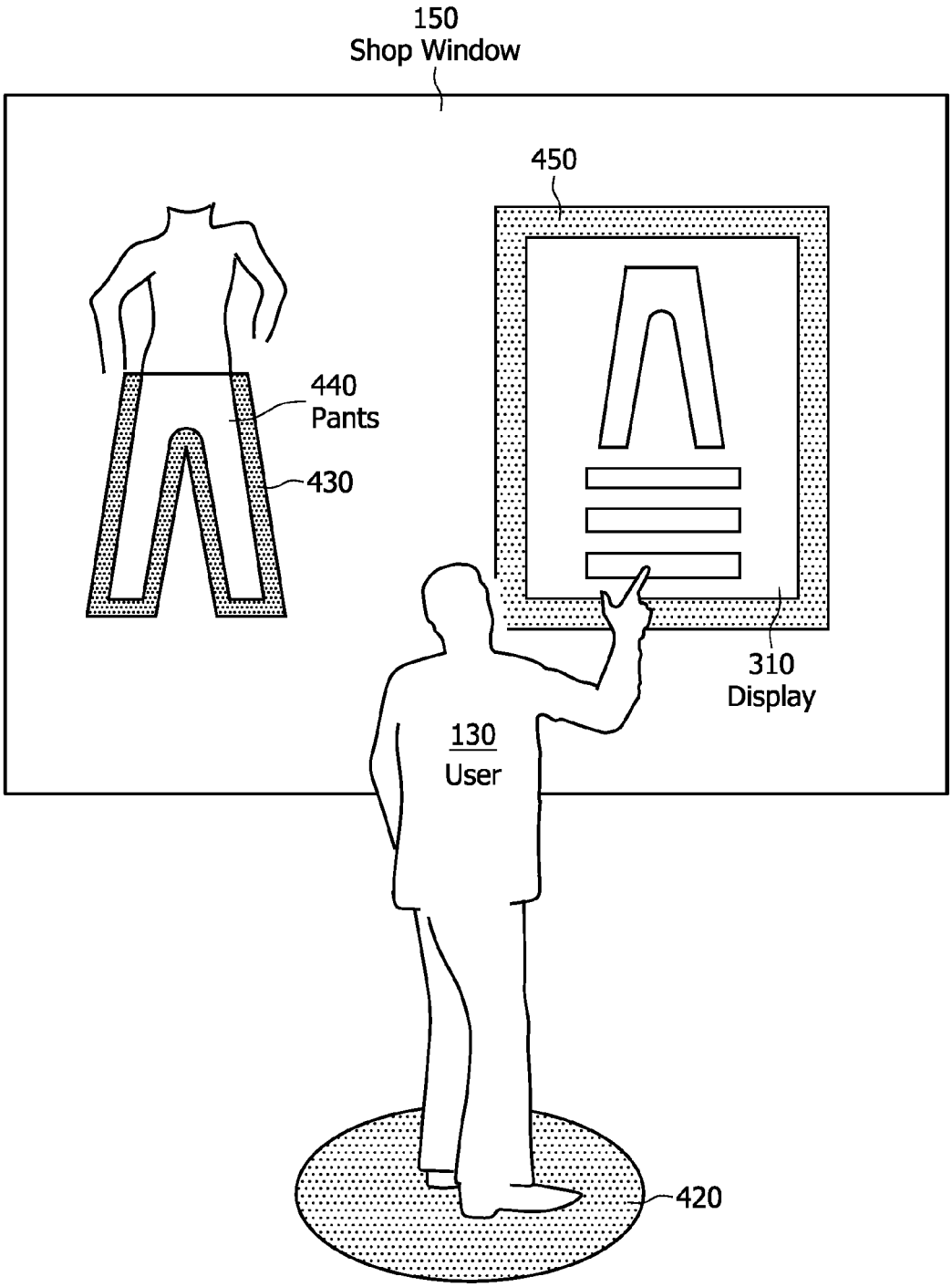
FIG. 4 shows a use of the interactive shop window according to the present invention.

Illustratively, for every user that approaches or interacts with the shop window 150, a new color is randomly assigned to each user. So that as soon as a user starts interacting with the shop window, items selected by the user get highlighted using the corresponding color assigned to that particular user. For example as shown in FIG. 4, the user 130 may be illuminated with the associated/assigned color by the circle 420 where the user 130 stands. The same color may also illuminate items selected by the user 130 where, for example, strip lighting 430 illuminates the periphery of a selected pair of pants 440 with the user's associated color. Further, the periphery 450 of the shop window display 310 (projected onto the shop window 150 upon user activation, such as gazing for a predetermined time or pointing, and used by the user 130 to interact with the shop window 150) may also be highlighted with the same color associated with or assigned to the current user 130.

For fashion shop window where mannequin dolls are used to display clothes items, electronically addressable LED array(s) can be integrated either into a mannequin itself or in every piece of clothing or product, such as the pair of pants 440. As soon as the user points either at a blouse, a skirt or the pair of pants 440 on the mannequin, the corresponding item gets 'highlighted' by switching on the corresponding LEDs associated or linked to the selected item. Flexible lighting strips having LEDs may be used, such as those disclosed in U.S. Pat. No. 6,846,094, issued Jan. 25, 2005, to John F. Luk, entitled "Flexible LED Lighting Strip" and U.S. Pat. No. 5,337,225, issued Aug. 9, 1994, to Marc A. Brookman, entitled "Lighting Strip System" which are incorporated herein by reference in its entirety, In another embodiment, if the user selects a product, either a physical product that may be selected with a pointing gesture, or an icon that corresponds to that product on the shop window display 310 or other device displays, then not only the product itself may be highlighted but also all 'related' products may be highlighted.

Of course, one skilled in the art may devise various combination of color-coding in view of the present disclosure, such as using same or similar colors for highlighting related products, with same or similar light attributes, such as same or similar intensity hue, saturation and the like. As described for example, the color intensity varies from its maximum, illuminating the user-selected product, to lower intensity for illuminating other related products, where for example, the next most relevant product, or promotional product which is on sale at a discounted price is illuminated with the next highest intensity level (e.g., slightly less intense than the maximum intensity), and further products are illuminated with even lower intensity levels and the like.

Related products may be products of the same brand as the user-selected product, the same product category, and/or compatible products. For example, when the user selects a photo camera, then related products (that may be illuminated with light having any desired light attribute) may be memory cards, batteries, printer, etc. Such related products may be defined by a shop owner in a separate user interface, in which the shop owner may combine products into groups so that as soon as one product is selected the whole group gets 'highlighted.' Each product may be a member of multiple groups.

In yet another embodiment, the user might want to compare several products in terms of available features, product characteristics, etc. In this case, the user selects several products such as, for example, by simultaneously pointing at two physical products with two hands.

Multiple touch points can be simultaneously detected using a capacitive sensing grid made of transparent electronics and embedded into the panel 150 of the shop window. Such grids may be implemented, for example, using a product known as SmartSkin from Sony Corp., or other devices, such as one to three dimensional capacitive sensing devices from EtherTouch™ of Cranford, N.J., USA.

Alternatively or in addition, multiple touch points may be detected with computer vision as is well known. Further, the user may first select a 'compare' function on the shop window display 310, for example, and then point sequentially at the physical products that the user wants to compare. As the user points at a product, a new list or column with product features is added to the product comparison chart on the shop window display 310.

It should be understood that various other embodiments may be devised by those skilled in the art in view of the present disclosure. For example, instead of the tiles/mats 210 or other light-emitting surfaces being used to place products 120 thereon, the tiles or mats 210 may be used to cover the back wall of the shop window. Thus, in some shop windows, it would be more appropriate due to its size, configuration, etc. to use the light-emitting surface on the wall behind the products that would create a highlighting physical background. In this case, as soon as a product has been selected, the corresponding section of the wall-background is highlighted. Of course, a separate surface of mat(s) or tile(s), for example, may be individually provided behind each product, such as in a substantially vertical position or substantially aligned with, e.g., parallel to, the associated product. In this case, a particular individual surface, or portions thereof, may be illuminated with light of desired attributes to highlight the product associated with, e.g., located in front of, the particular surface.

Figure 5:
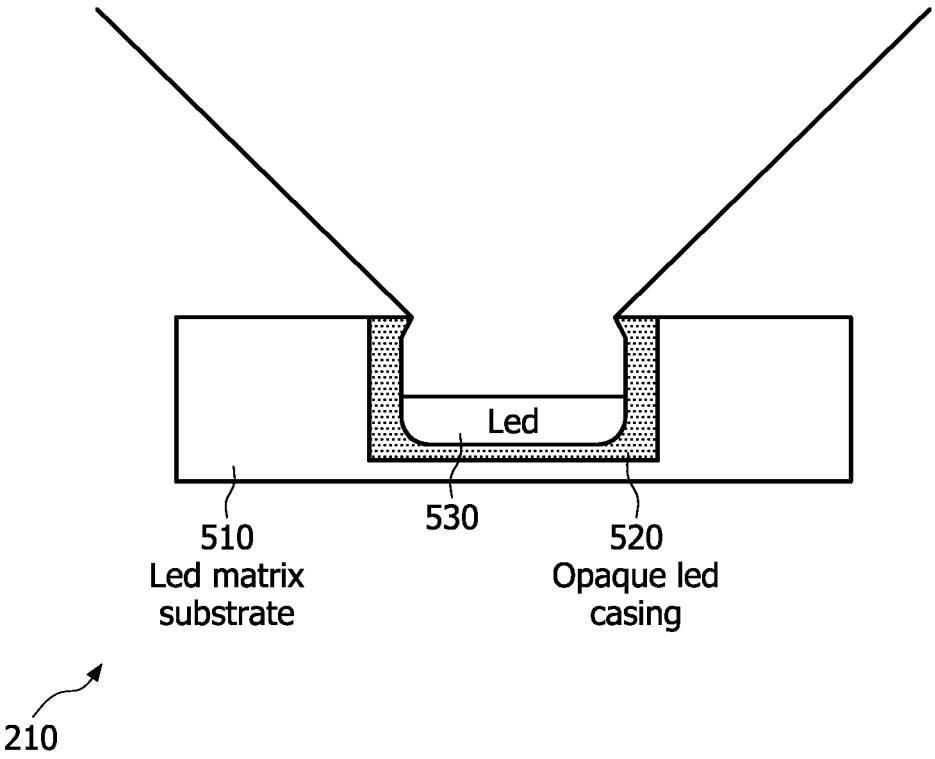
FIG. 5 shows an LED matrix embedded in a substrate according to another embodiment of the present invention.

Another embodiment, in the case where the light-emitting mats 210 are positioned under the product 120 horizontally, includes making the "highlight" only visible when the user/viewer 130 is standing close to the shop window, e.g., when looking from above. For this implementation, the LED mats 210 include a transparent LED matrix substrate 510 shown in FIG. 5, for light going upwards, and an opaque casing 520 surrounding each LED 530 to prevent or reduce sideward light. Thus, when someone is standing far from the shop window, the highlight would not be visible, since the LEDs would emit light upwards but not to the side. One advantage of such configuration is that users would be more inclined to interact with such shop window since it does not make their choices visible to everyone, preserving their privacy.

Of course, as it would be apparent to one skilled in the art of communication in view of the present description, various elements may be included such as a light source controller which may be separate or integrated with the processor. The controllable light source includes drivers and may also include other elements, such as elements for wireless communication and control including one or more transmitters, receivers, or transceivers, antennas, modulators, demodulators, converters, duplexers, filters, multiplexers etc., which may also be included or coupled to the processor or controller for wireless light control. Such well-known elements will not be further described in order not to obscure description of the present system and method.

As is well-known, the processor 140 executes instruction stored in the memory 195, for example, which may also store other data, such as predetermined or programmable settings related to control of the light source(s), including programmable grouping of lights and light attributes/settings to illuminate related, relevant or desired products, such as intensity (i.e., dimming function), color, hue, saturation, beam width, direction, color temperature, mixed colors, and the like, for the case of light source that may be controlled to change attributes of light emanating therefrom. Of course, the desired color attributes may be the same or different for groups or for lighting units within one group. That is, individual light units may provide light of different desired attributes despite being in a single group associated with a single consumer. Thus, one group of light sources provides a particular colored-light, where other light attributes may be varied, such as the intensity for example, to highlight/illuminate items 120 with varying degrees of highlighting.

It should be understood that the various component of the interaction system may be operationally coupled to each other by any type of link, including wired or wireless link(s), for example. Various modifications may also be provided as recognized by those skilled in the art in view of the description herein. The memory may be any type of device for storing application data as well as other data. The application data and other data are received by the controller or processor for configuring it to perform operation acts in accordance with the present systems and methods.

The operation acts of the present methods are particularly suited to be carried out by a computer software program, such computer software program preferably containing modules corresponding to the individual steps or acts of the methods. Such software can of course be embodied in a computer-readable medium, such as an integrated chip, a peripheral device or memory, such as the memory or other memory coupled to the processor of the controller or light module.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory 195.

Additional memories may also be used. The computer-readable medium, the memory 195, and/or any other memories may be long-term, short-term, or a combination of long-term and short-term memories. These memories configure the processor/controller 140 to implement the methods, operational acts, and functions disclosed herein. The memories may be distributed or local and the processor, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within memory, for instance, because the processor may retrieve the information from the network.

The processor 140 and the memory 195 may be any type of processor/controller and memory, such as those described in U.S. 2003/0057887, which is incorporated herein by reference in its entirety. The processor may be capable of providing control signals and/or performing operations in response to selecting and grouping light modules and/or selecting predetermined or programmable light settings, and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for highlighting desired products and/or feature(s) and providing feedback may be utilized in conjunction with further systems.

Of course, it is to be appreciated that any one of the above embodiments or processes may be combined with one or with one or more other embodiments or processes to provide even further improvements in highlighting desired product(s) and/or feature(s) as well as providing user feedback in response to a query, search and/or product(s)/feature(s) selection.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

The invention claimed is:

1. An interactive system for providing visual feedback in response to selection of one of a plurality of items by a user, the system comprising:

a plurality of communicably interconnected tiles, each of the tiles having a controllable light emitting source linked to at least one of said items;

the tiles being in communication with a system processor and each of the tiles including at least one sensor to detect at least one of said items placed on said tile;

wherein the system processor automatically updates links between each of said items and a tile on which the item is placed;

a display configured with the system processor wherein the display presents selectable search criteria about the plurality of items positioned on the plurality of tiles;

wherein each of the selectable search criteria is linked to at least one of the plurality of items;

each of the plurality of tiles each linked to at least one of the items;

the system processor configured to present the selectable search criteria and turn on said controllable light emitting source for at least one of the tiles and illuminate said item linked to the selected criteria in response to said user's interactive selection a search criteria, wherein said selection comprises at least one of the group consisting of pointing at said items, gazing at said item, and selecting said item from a representation thereof on a video display.

2. The interactive system of claim 1, wherein said controllable light emitting source is embedded in the tile.

3. The interactive system of claim 2, wherein said tile includes at least one of a matrix of photo detectors and matrix of pressure sensors configured to detect a base of said item when placed on said tile.

4. The interactive system of claim 1, further comprising a reader device attached to said controllable light emitting source for reading a tag attached to said item.

5. The interactive system of claim 1, further comprising a sensor configured to link said controllable light emitting source to said item.

6. The interactive system of claim 5, wherein said sensor includes a tag attached to said item, said system further comprising a reader configured to read said tag when said item is substantially near said reader.

7. The interactive system of claim 6, wherein said tag is an RFID tag, and said reader is an RFID reader.

8. The interactive system of claim 1, wherein said controllable light emitting source is configured to substantially illuminate at least one of a periphery of said item, a contour of a base of said item, and a background surface behind said item.

9. The interactive system of claim 1, wherein said controllable light emitting source includes at least one of a light emitting diode, incandescent, fluorescent, halogen, and high intensity discharge light source.

10. The interactive system of claim 1, further comprising a detector configured to detect at least one of said pointing and said gazing.

11. The interactive system of claim 1, wherein at least one of said items and a list of said items are color-coded and displayed on a display projected on a panel located between said item and said user.

12. The interactive system of claim 1, wherein said system processor is further configured to control additional controllable light emitting sources to illuminate said user with a color assigned to said user, and to illuminate a further user and products selected by said further user with a further color.

13. The interactive system of claim 1, wherein said system processor is further configured to compare at least two items selected by a user and to control further controllable light emitting sources linked to said at least two items for providing an indication of a feature in common between said at least two items.

14. A method of highlighting one of a plurality of items an object by a light source, the method comprising the acts of:

linking each of the plurality of items with one of a plurality of linked tiles, wherein each of the linked tiles includes an associated controllable light source;

communicating the linked items and the linked tiles to a system processor;

associating the plurality of items with a plurality of selectable feature information;

presenting the plurality of selectable feature information about each of the plurality of items for selection by a user, each of the plurality of selectable feature information associated with a unique color;

wherein the selectable feature information is linked by the system processor to at least one of the items;

selecting one of the plurality of selectable feature information using one of the group consisting of pointing, gazing and selecting from a representation of the feature information on a video display; and in response to said selecting act, controlling a light emitting source on the linked tiles so that at least one of said linked tiles associated with the selected one of the plurality of selectable feature information becomes illuminated.

15. The method of claim 14, wherein said controlling act substantially illuminates at least one of a periphery of said item, a contour of a base of said item, and a background surface behind said item.

16. An interactive system for providing visual feedback in response to selection of an item by a user, said system comprising:

a plurality of tiles, each of the tiles in communication with a system processor and having a controllable light source linked to an item and having at least one light-emitting diode for generating light of at least one varying attribute;

each of the plurality of tiles in bidirectional communication with the system processor and with each other;

wherein each of the plurality of tiles is linked by the system processor to one of a plurality of items, each of the plurality of items also linked by the system processor to one of a plurality of item features;

a display controlled by the system processor;

the system processor configured to display a plurality of selectable search criteria for selection by the user in a selection list;

wherein each of the plurality of selectable search criteria is linked to at least one of the plurality of items and the linked tile linked to the item;

the system processor configured to turn on said controllable light emitting source for at least one of the plurality of tiles and, in response to said selection of selectable search criteria on the selection list by said user, illuminate any of a plurality of items linked to the selected search criteria by communicating with the linked tile;

wherein said selection comprises at least one of the group consisting of pointing at said item, gazing at aid item, and selecting said item from a representation thereof on a display.

17. The interactive system of claim 16, wherein said attribute is selected from the group consisting of: color, color temperature, intensity, hue, saturation, beam width, and spot size.

18. The interactive system of claim 16, further comprising electronic drive circuitry for controlling said light source in coordination with said system processor.

19. The interactive system of claim 16, wherein the attribute of said light is varied based at least in part on at least one attribute of said item.

* * * * *